US006109678A

United States Patent [19]

Esfandiari et al.

[11] Patent Number: 6,109,678

[45] Date of Patent: Aug. 29, 2000

[54] NOTEBOOK COMPUTER CARRYING STRAP

[76] Inventors: Tony Esfandiari, 4782 Nomad Dr., Woodland Hills, Calif. 91364; Stanley Hirschman, 5960 W. Parker, #278, Plano, Tex. 75093; Margaret Clauder, 916 Wayland, Arlington, Tex. 76012

[21] Appl. No.: 09/435,509

[22] Filed: Nov. 8, 1999

[51] Int. Cl.[7] ..... A45F 5/10

[52] U.S. Cl. ..... 294/152; 294/137; 294/165

[58] Field of Search ..... 294/1.1, 27.1, 294/31.2, 137, 138, 147–157, 165; 16/114.1, 406, 407, 422; 24/442; 190/116; 220/752, 754, 758, 759; 224/901, 901.2, 901.4, 901.8; 229/117.19, 117.23; 248/205.2; 361/683

[56] References Cited

U.S. PATENT DOCUMENTS

| | | | |
|---|---|---|---|
| 1,594,724 | 8/1926 | Hansen . | |
| 1,617,629 | 3/1927 | Gale . | |
| 3,031,359 | 4/1962 | Blank et al. | 294/27.1 X |
| 3,563,433 | 2/1971 | Yoshiura | 294/157 |
| 3,923,222 | 12/1975 | Groves . | |
| 4,785,984 | 11/1988 | Seitz-Gangemi | 224/901.8 X |
| 4,850,502 | 7/1989 | Davis | 294/27.1 X |
| 4,881,684 | 11/1989 | Chinman | 294/152 X |
| 4,978,044 | 12/1990 | Silver | 294/149 X |
| 5,119,910 | 6/1992 | Heggeland | 224/901 X |
| 5,251,945 | 10/1993 | Stoops | 294/152 |
| 5,713,548 | 2/1998 | Boyer et al. | 224/901 X |
| 5,724,225 | 3/1998 | Hrusoff et al. . | |

*Primary Examiner*—Johnny D. Cherry
*Attorney, Agent, or Firm*—Jack Lo

[57] ABSTRACT

A carrying strap for a notebook computer includes a continuous loop strap generally formed into an elongated oval shape, which includes a generally parallel pair of generally straight portions with opposite ends connected by curved portions. The strap is folded about a transverse axis, and wrapped around a hinged bottom edge of a notebook computer. A plurality of separable fasteners are arranged in a series on an intermediate segment of each straight portion of the strap and attached to opposite sides of the computer. There are preferably four separable fasteners attached to each side of the computer. Each separable fastener is preferably comprised of a first hook-and-loop fastener detachably fastened to a second hook-and-loop fastener. The first hook-and-loop fastener is preferably fixedly attached to the strap by stitching, and the second hook-and-loop fastener is preferably fixedly attached to the computer by adhesive.

4 Claims, 1 Drawing Sheet

NOTEBOOK COMPUTER CARRYING STRAP

BACKGROUND OF THE INVENTION

1. Field of the Invention

This invention relates generally to carrying straps for notebook computers.

2. Prior Art

An important feature that users desire in a portable or notebook computer is lightweight—about 4 to 6 pounds. Users commonly purchase carrying cases for transporting notebook computers. However, a typical carrying case is thickly padded and large, so that it adds several pounds to the total carrying weight and defeats the advantage of the lightweight computer.

U.S. Pat. No. 5,724,225 to Hrusoff et al. shows a carrying tray for notebook computers. It includes straps attached to a rigid tray for supporting a computer in an operating position. However, different trays must be made for fitting different size computers. The tray also adds substantially to the total carrying weight. Other types of straps for carrying bags or the like are also known. U.S. Pat. No. 3,923,222 to Groves shows a bag carrier with a loop formed into a pair of straps, and a cross loop connecting the straps. The cross loop is formed of two sections connected by snaps.

If it is used to carry a notebook computer, the snaps would have to be disconnected to open the computer, and reconnected to carry the computer. When the snaps are disconnected, the carrying strap would be inconveniently separated from the computer. U.S. Pat. No. 1,617,629 to Gale shows a bag with looped straps secured by snaps. The strap is permanently attached to the bag through slots on the bottom of the bag. The strap cannot be adapted for carrying a notebook computer, because the snaps cannot be easily attached to the computer by a user. U.S. Pat. No. 1,594,724 to Hansen shows a looped strap permanently attached to a bag with rivets, thus it cannot be adapted for attaching to a notebook computer by a user.

OBJECTS OF THE INVENTION

Accordingly, objects of the present carrying strap are:

- to be easily attached to a notebook computer for conveniently carrying it;
- to be easily attached to the computer by a user without modifying the computer;
- to enable the computer to be opened with the strap still securely attached;
- to be easily removable from the computer if desired; and
- to be very inexpensive to manufacture.

Further objects of the present invention will become apparent from a consideration of the drawings and ensuing description.

BRIEF SUMMARY OF THE INVENTION

A carrying strap for a notebook computer includes a continuous loop strap generally formed into an elongated oval shape, which includes a generally parallel pair of generally straight portions with opposite ends connected by curved portions. The strap is folded about a transverse axis, and wrapped around a hinged bottom edge of a notebook computer. A plurality of separable fasteners are arranged in a series on an intermediate segment of each straight portion of the strap and attached to opposite sides of the computer. There are preferably four separable fasteners attached to each side of the computer. Each separable fastener is preferably comprised of a first hook-and-loop fastener detachably fastened to a second hook-and-loop fastener. The first hook-and-loop fastener is preferably fixedly attached to the strap by stitching, and the second hook-and-loop fastener is preferably fixedly attached to the computer by adhesive.

| | |
|---|---|
| 10. Strap | 11. Hinged Bottom Edge |
| 12. Notebook Computer | 13. Separable Fastener |
| 14. First Hook-And-Loop Fastener | 15. Second Hook-And-Loop Fastener |
| 16. Stitching | 17. Adhesive |
| 18. Straight Portions | 19. Curved Portions |

DETAILED DESCRIPTION OF THE INVENTION

Figure 1:
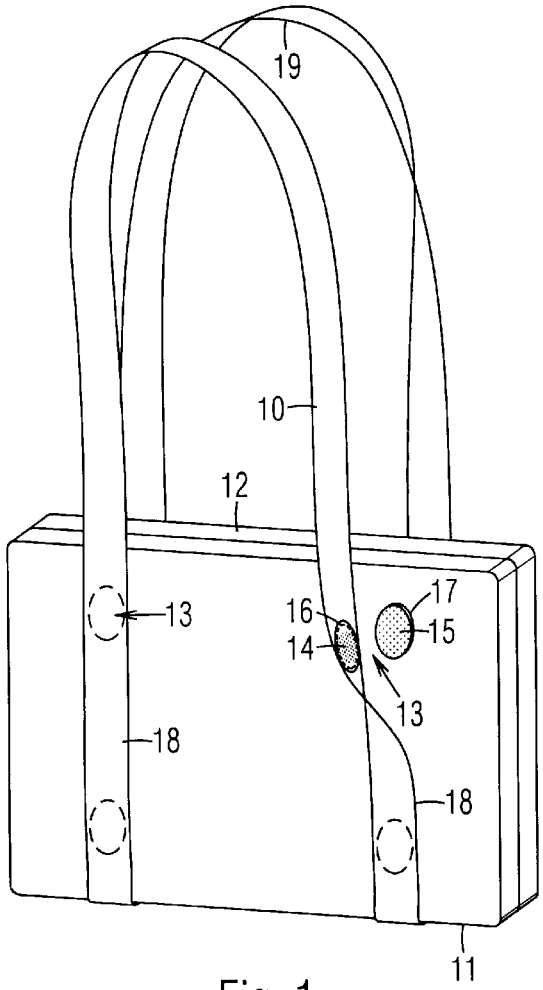
FIG. 1 is a side perspective view of the present strap attached to a notebook computer when the computer is closed.
Figure 2:
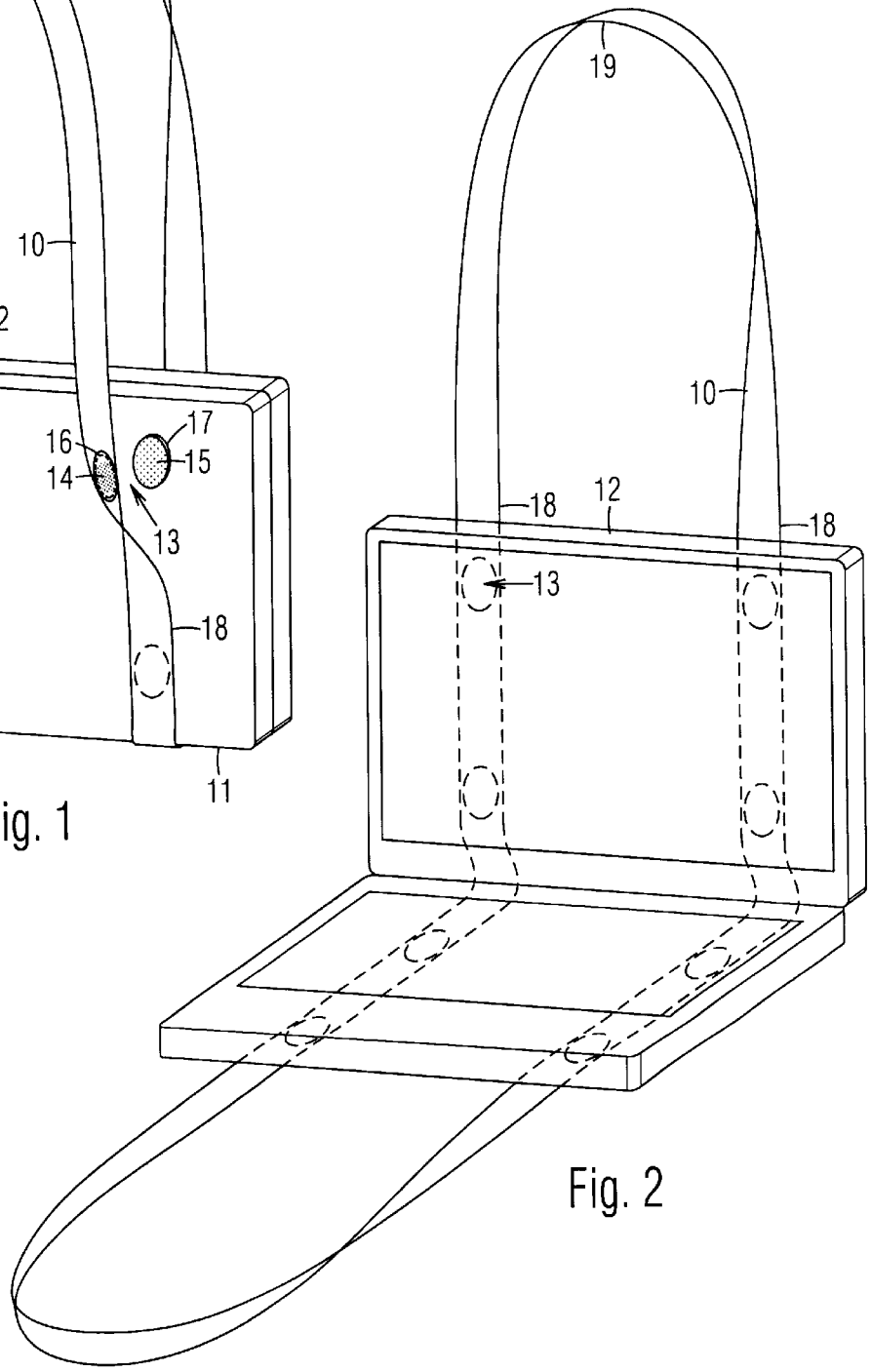
FIG. 2 is a side perspective view of the strap when the computer is opened.

A preferred embodiment of the present carrying strap is shown in the side perspective views in FIGS. 1–2. It includes a continuous loop strap 10 preferably made of a strong flexible webbing. Strap 10 is generally formed into an oval shape that includes a generally parallel pair of generally straight portions 18 with opposite ends connected by curved portions 19. Strap 10 is folded about a transverse axis, and wrapped around a hinged bottom edge 11 of a notebook computer 12. Strap 10 is long enough so that its ends project far enough from the top edge of computer 12 to form a pair of handles or shoulder straps. A plurality of separable fasteners 13 are arranged in a series on an intermediate segment of each straight portion 18 of strap 10 and attached to opposite sides of computer 12. There are preferably four separable fasteners 13 attached to each side of computer 12. Each separable fastener 13 is preferably comprised of a first hook-and-loop fastener 14 detachably fastened to a second hook-and-loop fastener 15. First hook-and-loop fastener 14 is preferably attached to strap 10 by stitching 16, and second hook-and-loop fastener 15 is preferably attached to computer 12 by adhesive 17.

The carrying strap is very inexpensive to manufacture. It is preferably sold with second hook-and-loop fasteners 15 already attached to first hook-and-loop fasteners 14. It is easily attached to computer 12 by a user by removing a protective backing (not shown) on adhesive 17, arranging strap 10 in an elongated loop on a supporting surface such as a table, putting bottom edge 11 of computer 12 on the middle of strap 10, and pressing second hook-and-loop fasteners 15 to the opposite sides of computer 12. The installation of the carrying strap does not require modification of computer 12 in any way, so that it can be attached to any notebook computer by the user. As shown in FIG. 2, it enables the computer to be opened while it is still securely attached. If desired, strap 10 can be quickly detached from computer 12 by separating first hook-and-loop fasteners 14 from second hook-and-loop fasteners 15. Further, if desired, the carrying strap can be completely uninstalled from computer 12 by detaching strap 10, and removing second hook-and-loop fasteners 15, which can be removed without harming computer 12 because they are attached with adhesive 17.

Although the above description is specific, it should not be considered as a limitation on the scope of the invention, but only as an example of the preferred embodiment. Many variations are possible within the teachings of the invention. For example, strap 10 may have opposite ends joined by a buckle, so that it is adjustable in length. Strap 10 may be entirely made of one portion of a hook-and-loop fastener, e.g., the loop portion, so that fasteners 13 are only comprised of the other portion, e.g., the hook portion. Therefore, the scope of the invention should be determined by the appended claims and their legal equivalents, not by the examples given.

We claim:

1. A carrying strap for a notebook computer, comprising:

a continuous loop strap formed into a generally elongated oval shape with an intermediate portion for wrapping around a hinged bottom edge of said computer, said loop strap being long enough so that opposite ends thereof are adapted to project beyond a top edge of said computer to form a pair of handles; and a plurality of separable fasteners with adhesive backs adapted to be securely attached to opposite sides of said computer without requiring permanent modification to said computer, said separable fasteners are separably attached to said intermediate portion of said loop strap, said loop strap is thus adapted to be detachable from and reattachable to said computer when desired, said separable fasteners are adapted to be removable from said computer without harming said computer.

2. The carrying strap of claim 1, wherein said loop strap is comprised of a loop fastener, and said separable fasteners are comprised of hook fasteners separably attached to said loop strap.

3. A carrying strap for a notebook computer, comprising:

a continuous loop strap formed into a generally elongated oval shape including a generally parallel pair of generally straight portions with opposite ends connected by curved portions, intermediate segments of said straight portions are adapted to be wrapped around a hinged bottom edge of said computer, said loop strap being long enough so that said curved portions are adapted to project beyond a top edge of said computer to form a pair of handles; and a plurality of separable fasteners arranged on said intermediate segments of said straight portions of said loop strap, each of said separable fasteners comprising a first hook-and-loop fastener separably fastened to a second hook-and-loop fastener, said first hook-and-loop fastener is fixedly attached to said loop strap, and said second hook-and-loop fastener includes an adhesive back adapted to be securely attached to said computer without requiring permanent modification to said computer, said loop strap is thus adapted to be detachable from and reattachable to said computer when desired, said second hook-and-loop fastener is adapted to be removable from said computer without harming said computer.

4. A carrying strap for a notebook computer, comprising:

a continuous loop strap made of webbing and formed into a generally elongated oval shape including a generally parallel pair of generally straight portions with opposite ends connected by curved portions, intermediate segments of said straight portions are adapted to be wrapped around a hinged bottom edge of said computer, said loop strap being long enough so that said curved portions are adapted to project beyond a top edge of said computer to form a pair of handles; and a plurality of separable fasteners arranged on said intermediate segments of said straight portions of said loop strap, each of said separable fasteners comprising a first hook-and-loop fastener separably fastened to a second hook-and-loop fastener, said first hook-and-loop fastener is stitched to said loop strap, and said second hook-and-loop fastener includes an adhesive back adapted to be securely attached to said computer without requiring permanent modification to said computer, said loop strap is thus adapted to be detachable from and reattachable to said computer when desired, said second hook-and-loop fastener is adapted to be removable from said computer without harming said computer.

* * * * *